US005833873A

United States Patent [19]

Adonetti

[11] Patent Number: 5,833,873

[45] Date of Patent: Nov. 10, 1998

[54] ALUMINUM CONCRETE FORMING SYSTEM

[75] Inventor: Anthony Adonetti, Greenwich, Conn.

[73] Assignee: Structural Countours, Inc., Greenwich, Conn.

[21] Appl. No.: 916,141

[22] Filed: Aug. 21, 1997

[51] Int. Cl.[6] ..... E04G 17/06

[52] U.S. Cl. ..... 249/47; 249/192; 52/578; 52/801.1; 52/630

[58] Field of Search ..... 52/424, 425, 427, 52/428, 429, 431, 432, 433, 437, 579, 580, 581, 630, 800.1, 801.1; 249/33, 47, 192, 219.2

[56] References Cited

U.S. PATENT DOCUMENTS

| | | | |
|---|---|---|---|
| 1,445,374 | 2/1923 | Wells . | |
| 2,019,195 | 10/1935 | Simpson . | |
| 2,107,427 | 2/1938 | Schwarzler | 249/33 X |
| 2,336,253 | 12/1943 | Jennings . | |
| 2,555,028 | 5/1951 | Davitt . | |
| 2,952,341 | 9/1960 | Weiler | 52/630 X |
| 3,003,218 | 10/1961 | Dorn . | |
| 3,221,957 | 12/1965 | Vevoda | 52/425 |
| 3,362,674 | 1/1968 | Gilbert | 249/192 |
| 3,447,771 | 6/1969 | Trimmer | 249/192 |
| 3,664,630 | 5/1972 | Maynen et al. | 249/47 X |
| 4,372,522 | 2/1983 | Simeonoff | 249/47 X |
| 5,078,360 | 1/1992 | Spera | 249/47 X |
| 5,160,640 | 11/1992 | Badstieber | 249/47 X |
| 5,544,852 | 8/1996 | Lee | 249/47 X |
| 5,552,103 | 9/1996 | Lee | 249/47 X |
| 5,632,923 | 5/1997 | Hayakawa | 249/47 |

FOREIGN PATENT DOCUMENTS

| | | | |
|---|---|---|---|
| 11785 | 6/1934 | Australia | 52/432 |
| 189342 | 2/1937 | Switzerland | 52/437 |

*Primary Examiner*—Creighton Smith
*Attorney, Agent, or Firm*—St. Onge Steward Johnston & Reens, LLC

[57] ABSTRACT

A panel for use in forming concrete and a concrete forming system. The panel comprises two symmetrical panel segments that each comprise a wall for supporting concrete, the wall having a length, a thickness and two sides, one of the sides terminating in and being integral with a supporting rail that extends the length of the wall. The second side of the wall terminates in at least one edge that also extends the length of the wall. The two panels are combined to form a complete panel by abutting their respective edges along their lengths so that each panel's respective rails are on opposite sides of the complete panel. A plurality of support members are then attached to the first and second panels segments to form the complete panel. The concrete forming system comprises a plurality of complete panels joined together so that they form a structure capable of supporting liquid concrete.

18 Claims, 7 Drawing Sheets

ALUMINUM CONCRETE FORMING SYSTEM

FIELD OF THE INVENTION

This invention relates generally to improvements in the field of forming concrete structures, and more particularly to construction methods where extruded aluminum panels of various widths and lengths are used in multiple configurations to form concrete walls, concrete beams, concrete slabs, concrete columns, etc.

BACKGROUND OF THE INVENTION

It is presently known that when constructing modern concrete structures, the use of an aggregation of panels, known as concrete forms, is necessary to contain liquid concrete until the concrete cures. These panels may be modular in design, and may be fabricated of various materials or a combination of materials such as steel, lumber, plywood, fiberglass, aluminum etc. Because of the loads imposed by liquid concrete, the form panels must be quite strong so that they do not deflect or deform. Thus, the panels must be able to sustain a flat, smooth, plane surface so as to create a highly acceptable concrete finish after the form panels are removed. After the concrete has been placed within the forms, the forms are left in place until the concrete has properly cured and attained sufficient strength so that it may be left unsupported, or temporarily supported for some additional length of time.

Of those concrete form panels that have been manufactured of aluminum, it has been a normal procedure in the art to fabricate such panels by the use of extruded side rails, extruded ribs, extruded end rails and a face sheet that had been produced initially in the form of a coil, which is eventually cut into desired sizes and flattened. Form panels manufactured of steel elements, or any combination of other elements may be fabricated in a similar manner, as applicable. After all of the extrusions and face sheet materials have been cut to the desired length and/or size, they are placed on a table specially designed for the purpose of assembling and welding these components into the desired width and length form panel. This process, however, is inefficient because it requires a great deal of labor and material due to the high amount of assembly, welding, and time necessary to achieve a desired form panel of sufficient strength, dimensional accuracy and flatness. In addition, the panels formed by the aforementioned technique are not very durable and produce a less than desirable surface finish due to the joints in the panel, especially the joint between the side rails and the face sheet.

It is also known in the art to manufacture narrow aluminum form panels, in their entirety, of widths such as 1" (25.4 mm) to 14" (355.6 mm) by an extrusion process. These narrow form panels can be extruded in their full width, including the side rails and form face and may be extruded in acceptable thickness which would not prohibit their use due to excessive cost or excessive weight. After extrusion, these panels must also be strengthened by means of welding additional ribs throughout the back of the form face at specified intervals. However, the extrusion of wider aluminum form panels 15" (381 mm) to 24" (609.6 mm) or wider has not been feasible due to the limitations of present extrusion press equipment. For instance, in order to extrude an aluminum form panel 24" (609.6 mm) wide the face would have to be very thick so as to "balance" the molten metal when passing through the extrusion press die. This would create a very heavy aluminum form panel, which would not be marketable due to the excessive cost necessitated by the large volume of metal.

Sliding mold elements, as exemplified in Dorn U.S. Pat. No. 3,003,218, have also been known in the art. The sliding mold element has two panels that overlap and are capable of linear movement in a plane substantially parallel to their own planes. However, due to the overlapping nature of the panels, the surface finish of the concrete suffers.

What is desired therefore, is a large extruded aluminum form panel of an acceptable weight and strength that would allow the panels to be economically manufactured and marketed, wherein the side rails and face surface may be extruded as one singular unit, and wherein the form panels provide an acceptable surface finish.

SUMMARY OF THE INVENTION

Accordingly, it is an object of the invention to provide aluminum form panels for the purpose of forming and supporting concrete while in its liquid state.

Another object of this invention is to provide extruded aluminum form panels without the joint between the Side Rails and the Face Sheet.

Still another object of this invention is to provide extruded aluminum form panels for the purpose of forming and supporting concrete while in its liquid state, that would be able to exceed the size restrictions imposed by present extrusion technology.

A further object is to provide extruded aluminum form panels for the purpose of forming and supporting concrete while in its liquid state, the panels being at least 15" (381 mm) wide by various lengths.

Yet another object of this invention is to provide extruded aluminum form panels for the purpose of forming and supporting concrete while in its liquid state, and to combine such form panels with similar and compatible extruded aluminum form panels of varying widths and lengths, resulting in the creation of a concrete forming system.

These and other objects are achieved in accordance with the present invention by providing a panel for use in forming concrete structures that comprises a first panel segment comprising a wall having a face for supporting concrete, the wall having a length, a thickness and two sides. One of the sides is integral with a supporting rail that extends the length of the wall. Another side, which is opposite the first mentioned side, terminates in an edge that also extends the length of the wall. The panel also has a second panel segment that has properties symmetrical to the first panel segment. When the first and second panel segments are placed in abutment along the lengths of their respective edges, they form a complete panel with the side rails being on opposite sides of the complete panel. In addition, a plurality of support members are attached to the non-concrete supporting face of the wall and the side rails of the first and second panel segments, thereby completing the panel.

Other objects and advantages will become more apparent from the following detailed description taken in consideration with the accompanying drawings.

DETAILED DESCRIPTION OF THE INVENTION

Figure 1:
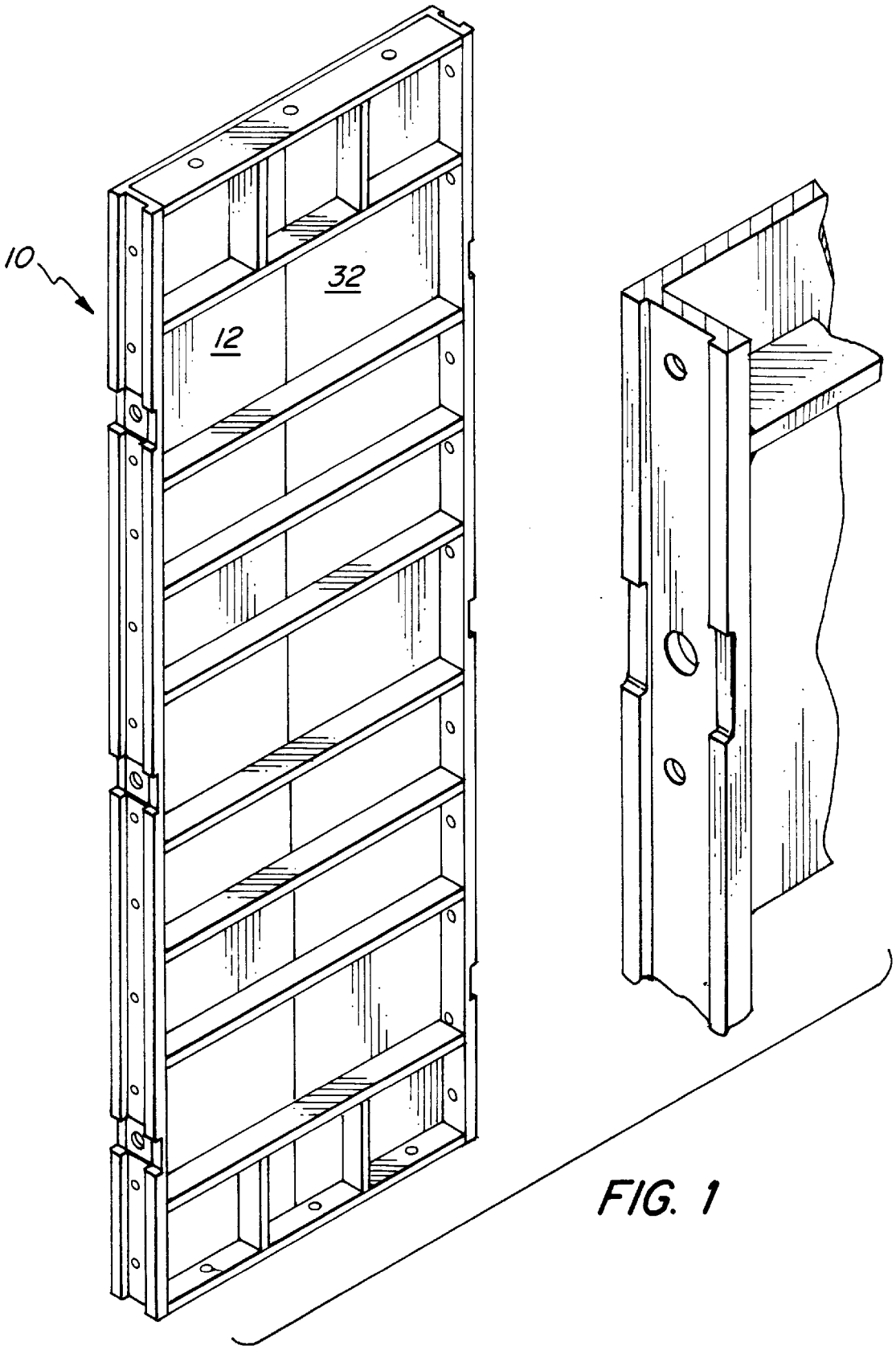
FIG. 1 is a perspective view of a complete panel assembly, along with an enlarged, cross-sectional, fragmentary view of a complete panel assembly.
Figure 2:
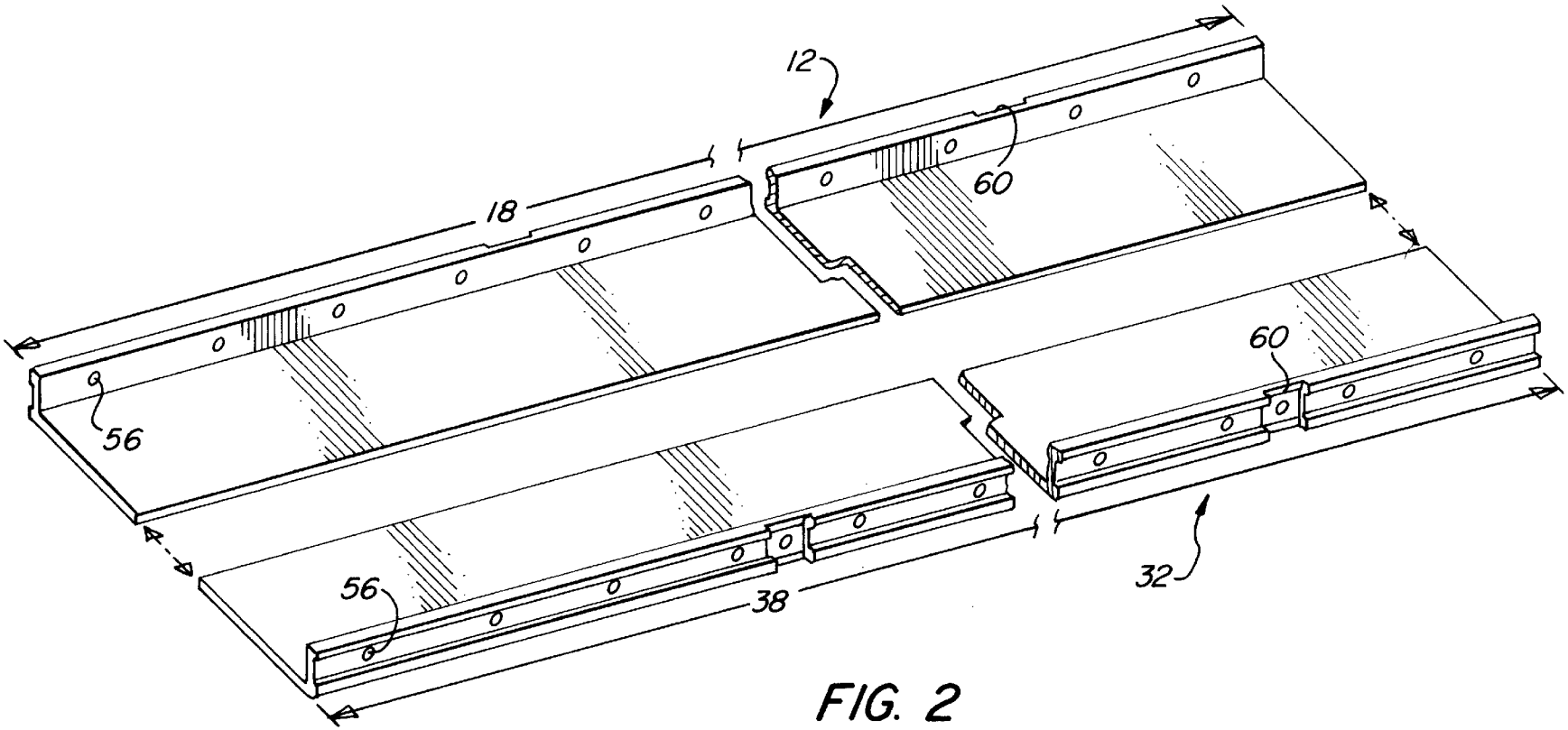
FIG. 2 is a perspective, fragmentary view of the panel in FIG. 1 with its panel segments apart and support members removed.
Figure 3:
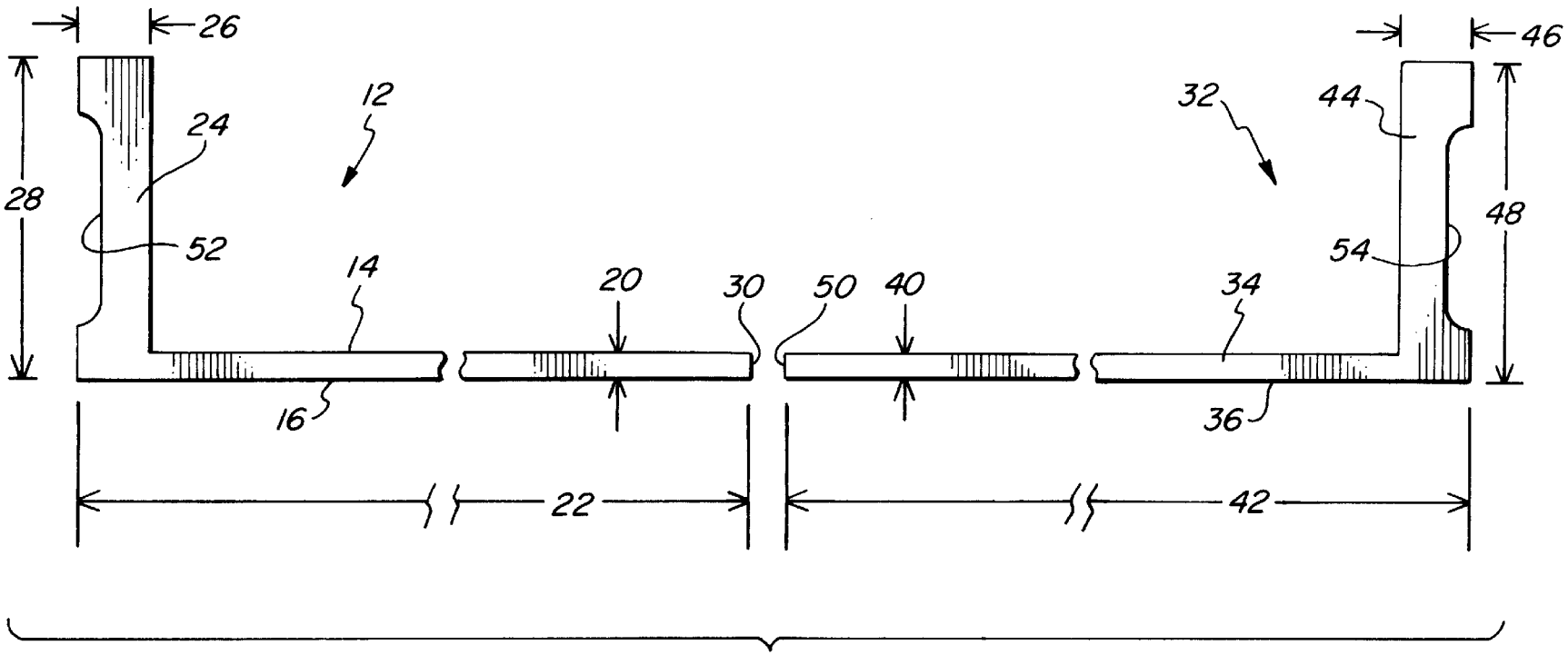
FIG. 3 is similar to FIG. 2, but instead shows a fragmentary end view of the two panel segments lying apart.

Referring first to the construction of an individual panel designated by the numeral 10 of FIG. 1 a first panel segment 12, as best seen in FIGS. 2 and 3, comprises a wall 14 having a face 16 for supporting concrete. The wall 14 being comprised of a length 18, a thickness 20, a width 22 and two sides. One of the sides terminates in and becomes integral with a rail 24 that extends along length 18 of wall 14 and is substantially perpendicular to wall 14. The rail 24 having a width 26 and a height 28. The other side of wall 14 terminates in an edge 30 that also extends along length 18 of wall 14.

A second panel segment 32 is symmetrical to first panel segment 10 and comprises a wall 34 having a face 36 for supporting concrete. The wall 34 being comprised of a length 38, a thickness 40, a width 42 and two sides. One of the sides terminates in and becomes integral with a rail 44 that extends along the length 38 of wall 34 and is substantially perpendicular to wall 34. The rail 44 having a width 46 and a height 48. The other side of the wall 34 terminates in an edge 50 that also extends along length 38 of wall 34.

It should be noted that edges 30 and 50 of panel segments 12 and 32 can be in the form of interlocking structures. Such an interlocking structure could be a tongue and grove assembly, wherein first panel segment would have a tongue and second panel segment would a groove (interlocking structure not shown). This type of arrangement would further support where the two panel segments meet and provide a stronger complete panel. Although a tongue and groove interlocking structure is described, any method of interlocking the two panels could be utilized.

Preferably, rails 24 and 44 have channels 52 and 54 that run along the length of rails 24 and 44 and are used to receive form ties. Within channels 52 and 54 are holes 56 that are spaced intermittently for the purpose of attaching form ties and/or assembly bolts and nuts. Rails 24 and 44 also have notches 60 that are used to facilitate the assembly a multitude of panels. In addition, the preferred embodiment of the invention has panel segments 12 and 32 where the ratio of the wall width 22 and 42 to the rail height 28 and 48, respectively, is at least two to one.

Figure 4:
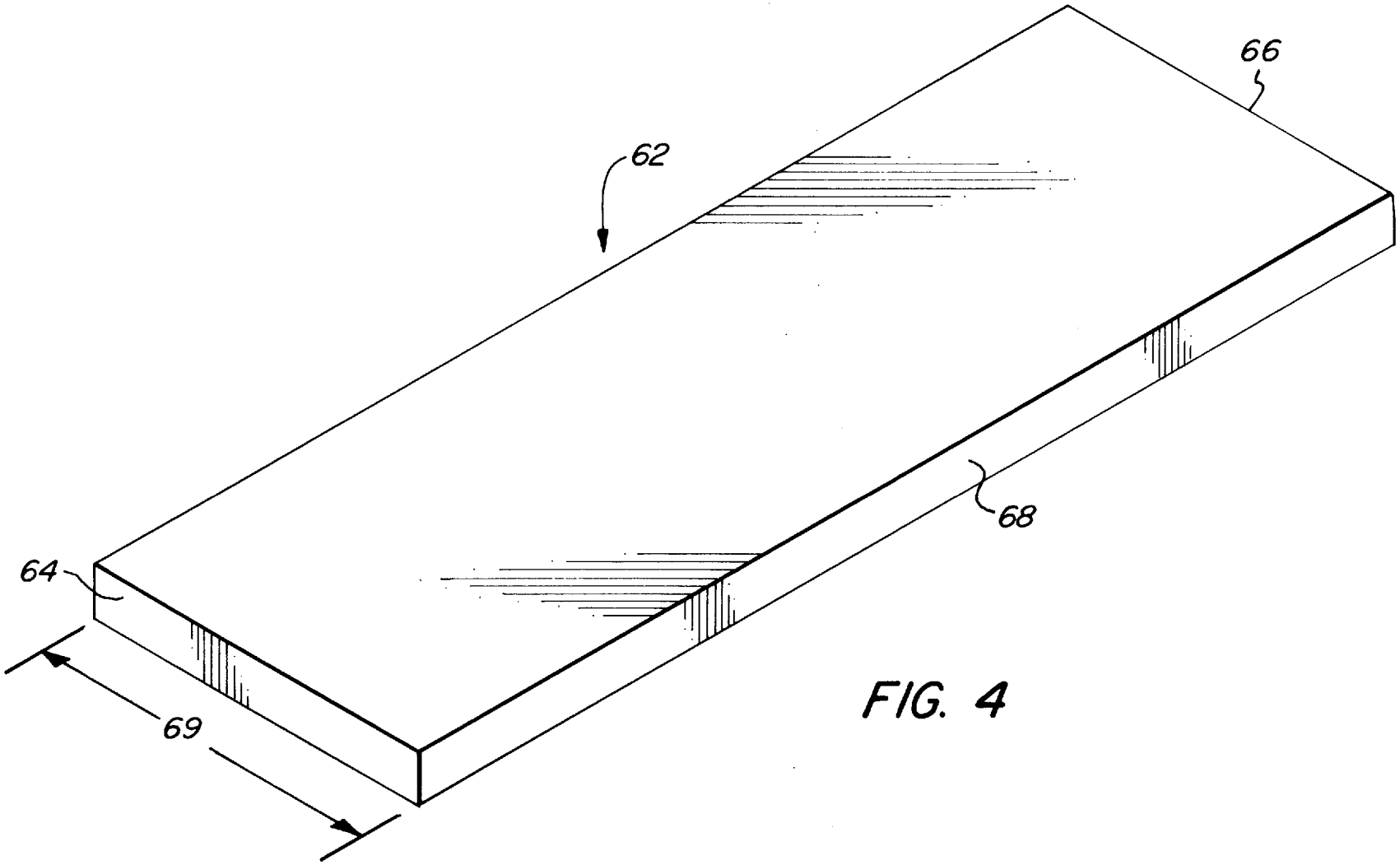
FIG. 4 is a perspective view of a support member.
Figure 5:
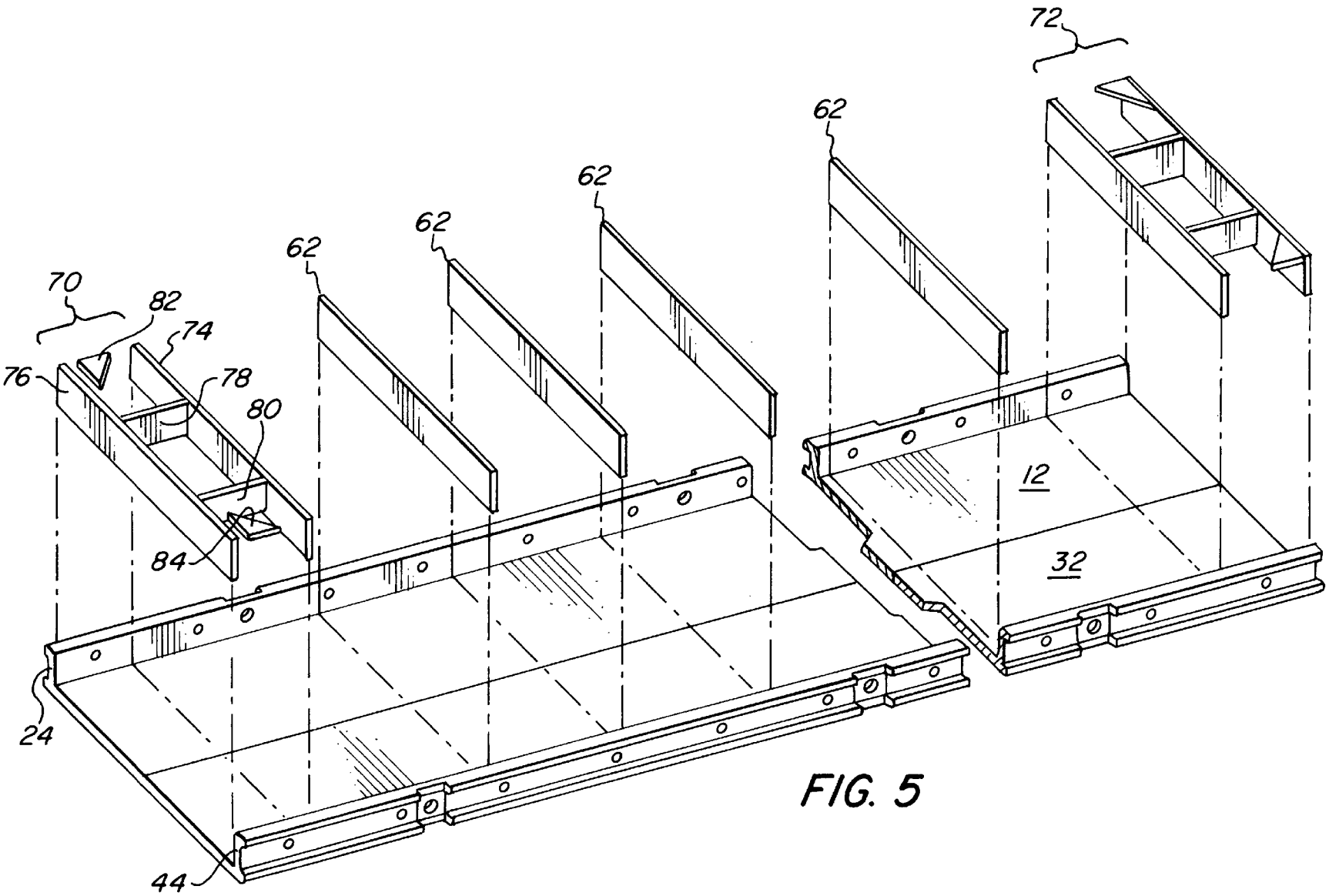
FIG. 5 is a fragmentary exploded view of the complete panel assembly seen in FIG. 1 with the support members and end pieces exploded.

In order to construct a complete panel 10, as best seen in FIG. 1, first panel segment 12 and second panel segment 32 are placed together so that their respective edges, 30 and 50 are in abutment along their lengths. Next, a plurality of support members 62, as best seen in FIGS. 4 and 5, are attached to the first panel segment 12 and the second panel segment 32 in such a fashion that they generally extend perpendicular to rails 24 and 44. It should be noted, however, that the support members need not extend perpendicular to rails 24 and 44, but may also extend at any angle that will produce the necessary support for panel segments 12 and 32 when combined. In a preferred embodiment, the support members 62 comprise ribs that are rectangular in cross-section. However, the ribs may also be triangular, circular, square, etc. in cross-section. Each of the support members 62 has a first end portion 64, a second end portion 66 a bottom edge 68 and a height 69. The support members 62 are positioned so that each first end portion 64 is in abutment with rail 24 of the first panel segment 12, the second end portion 66 is in abutment with rail 44 of the second panel segment 32, and the bottom edge 68 is in abutment with wall 14 of panel segment 12 and wall 34 of panel segment 32. Preferably, the support member height 69 is approximately equal to the height 28 and 48 of rails 24 and 44. The support members are placed at strategic intervals along the lengths of rails 24 and 44 so as to provide for the maximum load-carrying capability of the completed panel 10. Preferably, the support members are placed every ten to twelve inches, so that they prevent excessive deflections and/or deformation of walls 14 and 34. To attach the support members 62 to panel segments 12 and 32, a series of intermittent welds are used where the two end portions, 64 and 66, and the bottom edge 68 meet rails 24 and 44, and walls 14 and 34, respectively. Although intermittent welds are utilized in one embodiment of the invention, it should be understood that any other welding or fastening technique may be used to attach the support members 62 to the panel segments 12 and 32. Furthermore, one embodiment of the present invention has a weld on the back side of the panel that runs along the seam where panel segments 12 and 32 meet.

In addition to the configuration of support members 62 mentioned above, one embodiment of the invention also has two identical end sections 70 and 72 as best seen in FIG. 5. End sections 70 and 72 each comprise two support members 74 and 76 that are spaced closer together than the previously mentioned strategic intervals of the support members 62, and have between them two perpendicular bars 78 and 80. The two perpendicular bars 78 and 80 are spaced equidistant from the ends of support members 74 and 76 so as to form the end piece. In addition, two triangular corner pieces 82 and 84 are attached to the end pieces to add further support to the end pieces, increase overall rigidity of the forms and to aid in maintaining square corners. In one embodiment of the invention, the first and second panels 12 and 32 along with support members 62 and end pieces 70 and 72 are made of an extruded aluminum alloy.

Figure 6:
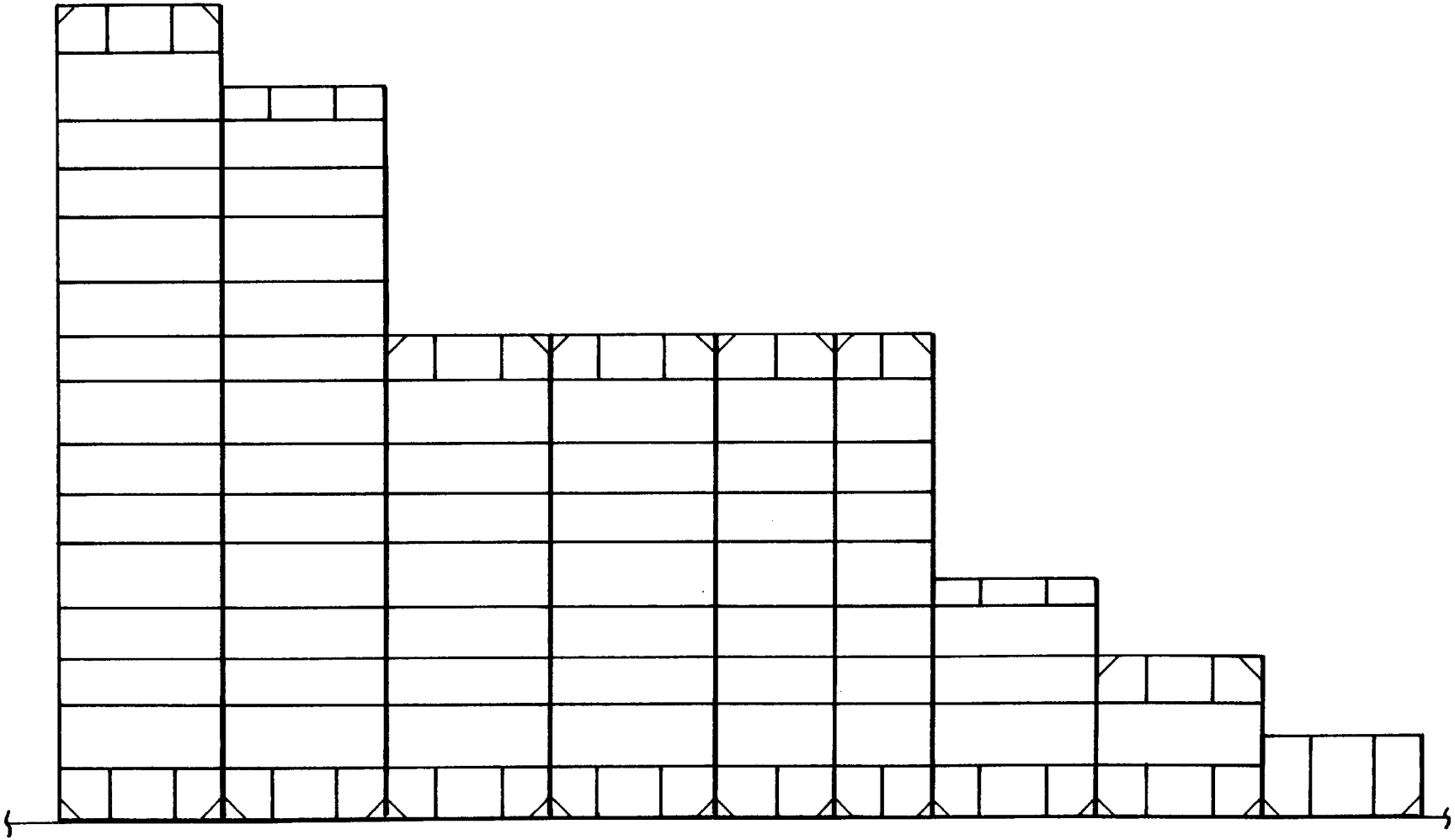
FIG. 6 is a front elevation view of a plurality of complete panels assembled and adjoining, the panels having different lengths and widths.

A particular advantage of the current invention is that it allows for the construction of a complete panel 10 that can be a multitude of different widths and lengths by varying the extruded widths and lengths of the first and second panel segments 12 and 32 (See FIG. 6). For example, if the first panel segment 12 is extruded at a different width than the second panel segment 32, combining the widths of two first panel segments 12 will produce a complete panel 10 of a different width than the combination of a first panel segment 12 and a second panel segment 32. Similarly, a combination of two second panel segments 32 will produce a completed panel 10 of a different width than the two other panel segment combinations just mentioned. Accordingly, if three different panel segment widths are extruded, six different complete panel 10 widths can be realized and if four different panel segment widths are produced, ten different complete panel 10 widths can be realized, etc. It should be understood that in addition to varying the widths of the complete panels 10, as described above, it is also possible to vary the lengths of the individual panel segments 12 and 32 to then allow for the construction of complete panels 10 of varying lengths and widths (See FIG. 6). In addition, because the side rails 24 and 44 and the faces 16 and 36 are extruded as a single unit, it allows for the construction of an odd width panel, such as 23-½" (596.9 mm) or 19-¾ (501.65), etc., by merely cutting each panel segment 12 and 32 along their lengths to reduce the width of the face. This would be particularly efficient where one would want to reduce the number of extrusions necessary to fulfill and order placed by a client.

Figure 7:
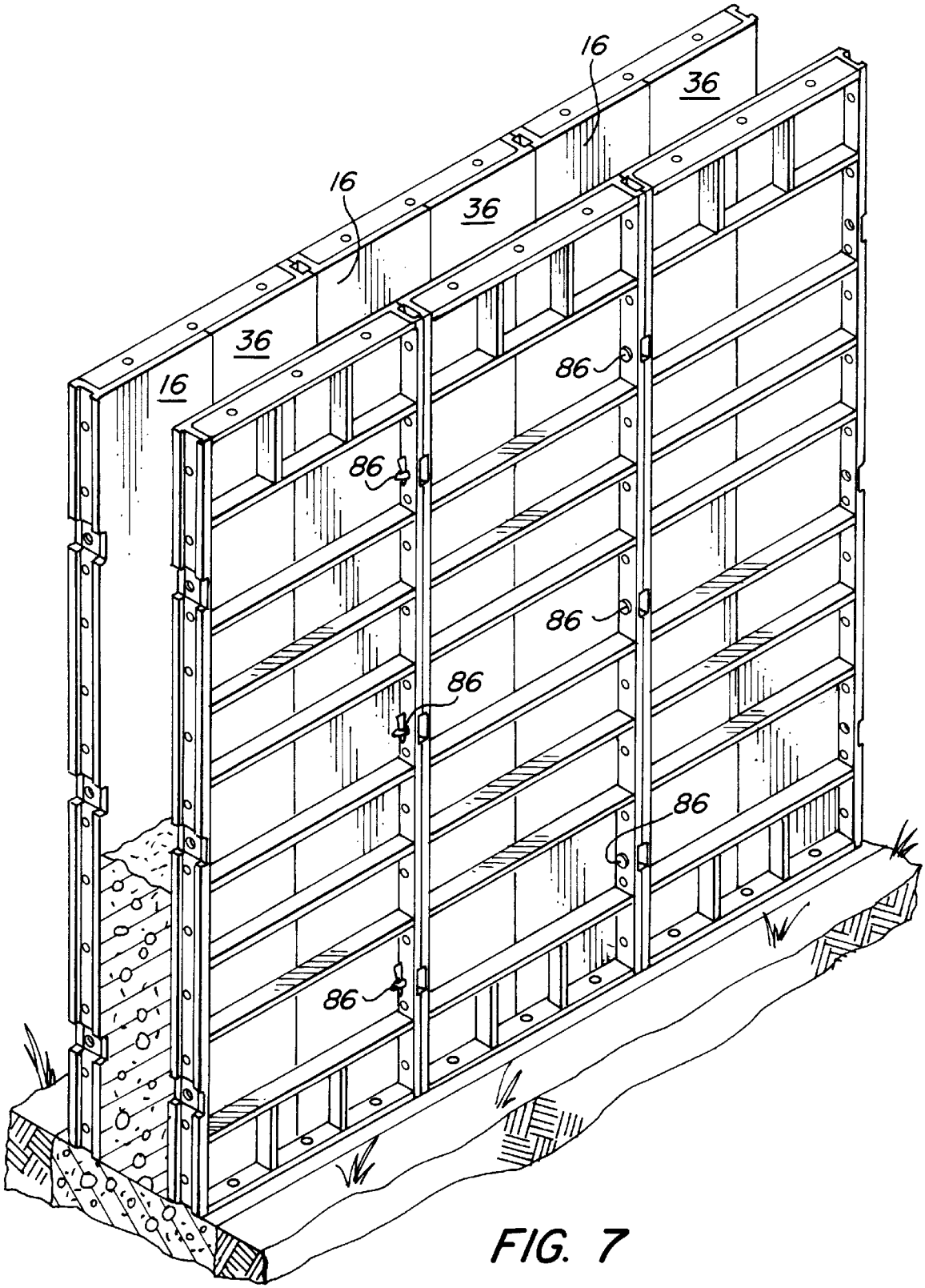
FIG. 7 is similar to FIG. 6, but instead shows a perspective view of a plurality of panels in an assembled arrangement to support liquid concrete.

Now referring to FIG. 7, once a plurality of complete panels 10 are manufactured according to this specification, it is then possible to combine a multitude of complete panels 10 to fabricate a structure capable of supporting the liquid concrete until the concrete cures. In order to do this, the complete panels 10 are positioned so that the faces 16 and 36 for supporting concrete of first and second panels segments 12 and 32 are along the inner perimeter of the structure, and so that they will be substantially in contact with the liquid concrete once it is poured into the structure. The complete panels 10 are connected to one another by the use of form ties 86 that are may be made of steel or fiberglass reinforced plastic. The form ties 86 are connected to complete panels 10 by means of slotted steel tie pins and steel wedges (not shown).

It should be appreciated that by extruding a large aluminum form panel in two halves with each have having a side rail that it integral with its respective face, a more rigid, durable aluminum form panel will be produced, which will increase the longevity of the panels and reduce the amount of maintenance required, thus providing greater benefits to the owners of such equipment throughout its life.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A panel for use in forming concrete structures, said panel comprising:

a first panel segment comprising a wall having a face for supporting said concrete, said wall having a length, a thickness and two sides, one of said sides terminating in and being integral with a supporting rail, said rail extending the length of said wall and being substantially perpendicular to said wall, said wall having a second side terminating in at least one edge, said edge extending the length of said wall;

a second panel segment comprising a wall having a face for supporting said concrete, said wall having a length, a thickness and two sides, one of said sides terminating in and being integral with a supporting rail, said rail extending the length of said wall, and being substantially perpendicular to said wall, said wall having a second side terminating in at least one edge, said edge extending the length of said wall;

wherein said edges of said first and second panel segments being in abutment along their lengths form a panel with said rails located on opposite sides of said panel and running the length of said panel segments;

a plurality of support members, said support members being substantially secured to said wall and said rail of said first and second panel segments to form said panel.

2. A panel according to claim 1 wherein said first and second panel segments each comprise an extruded metal alloy and each has a uniform cross section along its length.

3. A panel according to claim 2 wherein said extruded metal alloy comprises an aluminum alloy.

4. A panel according to claim 1 wherein the wall has a width and the rail has a height, the ratio of said wall width to said rail height for each said panel segment is at least two to one.

5. A panel according to claim 1 wherein each of said support members comprises a first and second end portion and a bottom edge, said support members extending in a generally perpendicular relationship to said rails, and said first end portion of each said support member in abutment with said rail of said first panel segment and said second end portion of each said support member being in abutment with said rail of said second panel segment, said bottom edge of said support member being in abutment with said walls of said first and second panel segments, said first and second end portions and said bottom edge of said support member being secured to said rails and said walls of said first and second panel segments to form said panel.

6. A panel according to claim 1 wherein said support members are secured to said first and second panel segments with a series of welds.

7. A panel according to claim 1 wherein said rails each have a height said support members each have a height and wherein said support member height is approximately equal to said height of said rails.

8. A panel according to claim 1 wherein said support members comprise extruded metal alloy.

9. A panel according to claim 8 wherein said extruded metal alloy comprises an aluminum metal alloy.

10. A method of manufacture of panels for use in forming concrete structures, the method comprising:

extruding a first panel segment comprising a wall having a face for supporting said concrete, said wall having a length, a thickness and two sides, one of said sides terminating in and being integral with a supporting rail, said rail extending the length of said wall and being substantially perpendicular to said wall, said wall having a second side terminating in at least one edge, said edge extending the length of said wall;

extruding a second panel segment comprising a wall having a face for supporting said concrete, said wall having a length, a thickness and two sides, one of said sides terminating in and being integral with a supporting rail, said rail extending the length of said wall and being substantially perpendicular to said wall, said wall having a second side terminating in at least one edge, said edge extending the length of said wall;

placing said edge of said first panel segment in abutment with said edge of said second panel segment; and securing a plurality of support members substantially to said wall and said rail of said first and second panel segments to form said panel.

11. A method according to claim 10 wherein each of said support members comprises a first and second end portion and bottom edge, said support members extending in a generally perpendicular relationship to said rails, said securing including, for each said support member, attaching said first end portion of said support member to said rail of said first panel segment, attaching said second end portion of said support member to said rail of said second panel segment, and attaching said bottom edge to said walls of said first and second panel segments.

12. A method according to claim 10 wherein said securing method comprises a plurality of intermittent welds.

13. A method of manufacture of panels having at least three different widths for use in forming concrete, the method comprising:

extruding a plurality of first panel segments, each first panel segment comprising a wall having a face for supporting said concrete, said wall having a length, a thickness, a width and two sides, one of said sides terminating in and being integral with a supporting rail, said rail extending the length of said wall and being substantially perpendicular to said wall, said wall having a second side terminating in at least one edge, said edge extending the length of said wall;

extruding a plurality of second panel segments, each second panel segment comprising a wall having a face for supporting said concrete, said wall having a length, a thickness, a width and two sides, one of said sides terminating in and being integral with a supporting rail, said rail extending the length of said wall and being substantially perpendicular to said wall, said wall having a second side terminating in at least one edge, said edge extending the length of said wall wherein said width of said first panel segment is greater than said width of said second panel segment;

selecting among three panel widths corresponding to the (1) combined widths of two first panel segments, (2) the combined width of a first panel segment and a second panel segment, or (3) the combined widths of two second panel segments;

placing the edge of one panel segment in abutment with another panel segment to form a panel having a combined width of (1), (2) or (3) of the preceding paragraph;

securing a plurality of support members substantially to said wall and said rail of said first and second panel segments.

14. A method according to claim 13 wherein said securing method comprises a plurality of intermittent welds.

15. A method according to claim 13 wherein each of said support members comprises a first and second end portion and a bottom edge, said support members extending in a generally perpendicular relationship to said rails, said securing including, for each said support member, attaching said first end portion of said support member to said rail of said first panel segment, attaching said second end portion of said support member to said rail of said second panel segment, and attaching said bottom edge to said walls of said first and second panel segments.

16. A method of forming concrete, the method comprising:

extruding a plurality of first panel segments, each first segment comprising a wall having a face for supporting said concrete, said wall having a length, a thickness, a width and two sides, one of said sides terminating in and being integral with a supporting rail, said rail extending the length of said wall and being substantially perpendicular to said wall, said wall having a second side terminating in at least one edge, said edge extending the length of said wall;

extruding a plurality of second panel segments, each second segment comprising a wall having a face for supporting said concrete, said wall having a length, a thickness, a width and two sides, one of said sides terminating in and being integral with a supporting rail, said rail extending the length of said wall and being substantially perpendicular to said wall, said wall having a second side terminating in at least one edge, said edge extending the length of said wall wherein said width of said first panel segment is greater than said width of said second panel segment;

selecting among three panel widths corresponding to the (1) combined widths of two first panel segments, (2) the combined width of a first panel segment and a second panel segment, or (3) the combined widths of two second panel segments;

placing the edge of one panel segment in face to face relation with another panel segment edge to form a panel having a combined width of (1), (2) or (3) of the preceding paragraph;

securing a plurality of support members substantially to said wall and said rail of said first and second panel segments;

combining a plurality of said panels, such that they form a structure capable of supporting said concrete until said concrete cures, said faces for supporting said concrete positioned such that they are substantially in contact with said concrete.

17. A method according to claim 16 wherein each of said support members comprises a first and second end portion and a bottom edge, said support members extending in a generally perpendicular relationship to said rails, said securing including, for each said support member, attaching said first end portion of said support member to said rail of said first panel segment, attaching said second end portion of said support member to said rail of said second panel segment, and attaching said bottom edge to said walls of said first and second panel segments.

18. A method according to claim 16 wherein said securing method comprises a plurality of intermittent welds.

* * * * *